US006382617B1

(12) United States Patent
Yen et al.

(10) Patent No.: US 6,382,617 B1
(45) Date of Patent: May 7, 2002

(54) PAPER ACCOMMODATING ASSEMBLY FOR OFFICE MACHINE

(75) Inventors: Wei-Feng Yen; Kun-Yee Yang, both of Taoyuan (TW)

(73) Assignee: Acer Communications & Multimedia, Inc., Taoyuan (TW)

( * ) Notice: Subject to any disclaimer, the term of this patent is extended or adjusted under 35 U.S.C. 154(b) by 0 days.

(21) Appl. No.: 09/610,599

(22) Filed: Jul. 5, 2000

(30) Foreign Application Priority Data

Aug. 21, 1999 (TW) ..... 88214240 U

(51) Int. Cl.[7] ..... B65H 5/22; B65H 83/00; B65H 85/00; B65H 1/26

(52) U.S. Cl. ..... 271/3.14; 271/126; 271/157; 271/162

(58) Field of Search ..... 271/3.14, 4.08, 271/4.09, 4.1, 9.11, 157, 162, 163, 164, 207

(56) References Cited

U.S. PATENT DOCUMENTS 5,346,197 A * 9/1994 Takano et al. ..... 271/127 X
5,387,043 A 2/1995 Fujioka et al.
5,480,132 A * 1/1996 Kiyohara et al. .... 271/10.01 X
D370,025 S 5/1996 Weng
D382,583 S 8/1997 Takahashi et al.
D387,085 S 12/1997 Masujima et al.
D390,258 S 2/1998 Kawahara et al.
D400,918 S 11/1998 Kobayashi et al.
D411,228 S 6/1999 Kobayashi et al.
5,957,447 A * 9/1999 Sekine ..... 271/9.09 X
6,029,970 A * 2/2000 Hwang ..... 271/9.11 X
6,072,515 A * 6/2000 Miura ..... 271/162 X
6,155,680 A * 12/2000 Belon et al. ..... 271/225 X

* cited by examiner

*Primary Examiner*—Christopher P. Ellis
*Assistant Examiner*—Gene O. Crawford
(74) *Attorney, Agent, or Firm*—Harness, Dickey & Pierce, PLC

(57) ABSTRACT

A paper accommodating assembly for an office machine is provided in the invention. The paper accommodating assembly includes a first paper accommodating device for accommodating paper sheets to be processed by the office machine and a second paper accommodating device for accommodating paper sheets being processed by the office machine. In particular, feeding path of the paper sheets accommodated by the second paper accommodating device is established or blocked in response to the movement of the first paper accommodating device. The paper accommodating assembly of the invention can reduce space occupied by the office machine and avoid paper jam due to the closing of the first paper accommodating device.

18 Claims, 4 Drawing Sheets

PAPER ACCOMMODATING ASSEMBLY FOR OFFICE MACHINE

FIELD OF THE INVENTION

The present invention relates to a paper accommodating assembly of an office machine, such as a printer, a copy machine, a scanner, a fax, a multi-function office machine or an all-in-one office machine, for accommodating paper sheets to be processed and paper sheets having been processed by the office machine.

BACKGROUND OF THE INVENTION

An office machine inevitably requires a component, such as a cassette, a tray, a slot or the like, for accommodating paper sheets to be processed by the office machine. The office machine also requires a component, such as a cassette, a tray, a slot or the like, for accommodating paper sheets having been processed by the office machine.

The current design for office machines gravitate towards the desk-top type, multi-function and even all-in-one in order to increase usefulness and portability. The so-called multi-function or all-in-one office machines combine the capabilities of a wide range or a full range of office equipment into one. Obviously, the aforesaid office machines require simple-configuration, light-weight and compact components to reduce weight of the machines and space occupied by the machines. Therefore, paper accommodating devices of various type have been developed, e.g., the paper accommodating devices capable of moving within the office machine, or the paper accommodating devices capable of serving as a smooth surface of the office machine as being closed. The related prior arts are as follows: U.S. Pat. Nos. 5,387,043; D411,228; D400,918; D390,258; D370,025; D387,085; and D382,583.

However, the initial paper accommodating device and finish paper accommodating device disclosed in the prior arts are designed to operate independently from each other, which means the feeding operation of paper sheets accommodated by the initial paper accommodating device is not influenced by the operation of the finish paper accommodating device. That is why a finish paper accommodating device could remain closed when the feeding operation of paper sheets accommodated by an initial paper accommodating device still proceeds. Paper jam usually occurs in the office machine equipped with such initial and finish paper accommodating devices.

Accordingly, an objective of the invention is to provide an initial paper accommodating device and a finish paper accommodating device of an office machine. The initial paper accommodating device is for accommodating paper sheets to be processed by the office machine. The finish paper accommodating device is for accommodating paper sheets having been processed by the office machine. In particular, the finish paper accommodating device is rotatably closed or open. When closed, the finish paper accommodating device serves as a smooth surface of the office machine. The initial paper accommodating device is capable of moving within the office machine whereby the space occupied by the office machine can be reduced.

In addition, another objective of the invention is to assemble the aforesaid initial and finish paper accommodating devices so that the feeding path of paper sheets accommodated by the initial paper accommodating device is connected or blocked in response to the closing or opening of the finish paper accommodating device.

SUMMARY OF THE INVENTION

It is the objective of the invention to provide a paper accommodation assembly for an office machine for accommodating paper sheets to be processed and paper sheets having been processed by the office machine. In particular, the paper accommodating assembly can reduce the space occupied by the office machine.

Another objective of the invention is to provide a paper accommodating assembly for an office machine. In particular, the paper accommodating assembly is capable of selectively connecting or blocking the feeding path of paper sheets to be processed by the office machine to prevent from paper jams.

According to a preferred embodiment of the invention, the office machine also includes a pickup roller. When contacting the paper sheets on top to be processed by the office machine, the pickup roller selectively picks up the uppermost paper sheet and further delivers the uppermost paper sheet. The paper accommodating assembly includes a first paper accommodating device and a second paper accommodating device. The first paper accommodating device is pivotally mounted on the office machine. When rotated to an open position, the first paper accommodating device is for accommodating paper sheets having been processed by the office machine. When rotated to a closed position, the first paper accommodating device serves as a smooth surface of the office machine. The second paper accommodating device is for accommodating the paper sheets to be processed by the office machine. The second paper accommodating device supports the paper sheets moving forward to the pickup roller in response to the movement of the first paper accommodating device.

The advantage and spirit of the invention may be understood by the following recitations together with the appended drawings.

BRIEF DESCRIPTION OF THE APPENDED DRAWINGS

Figure 2A:
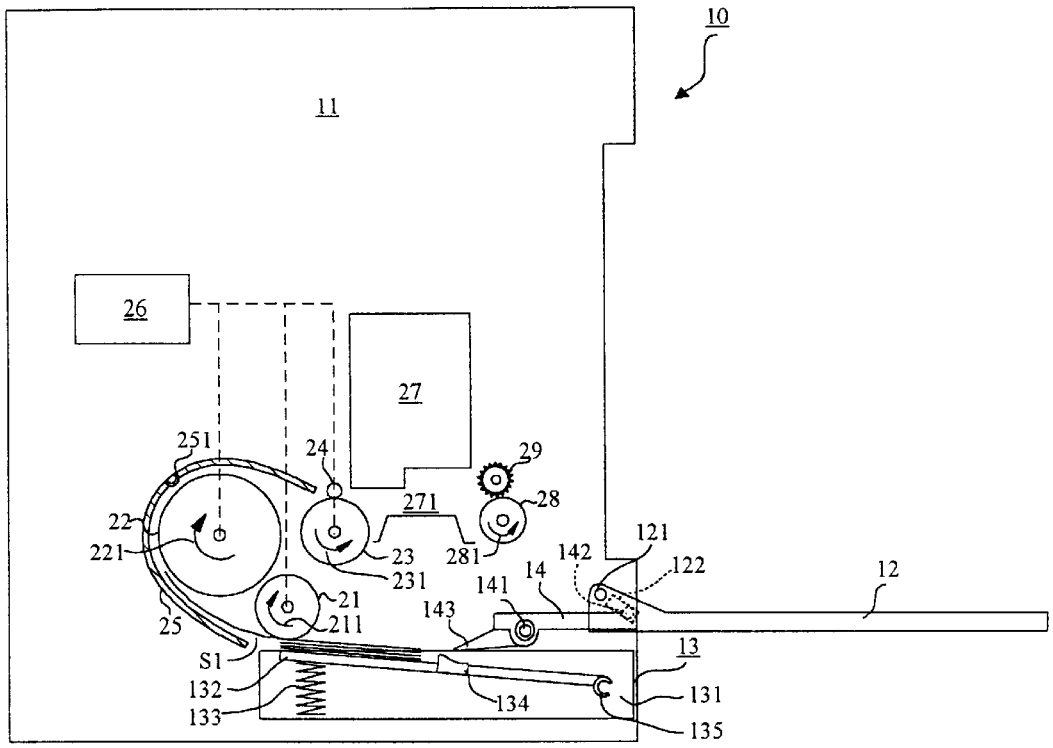
FIGS. 2A and 2B are diagrams showing internal construction of the office machine 10.
Figure 2B:
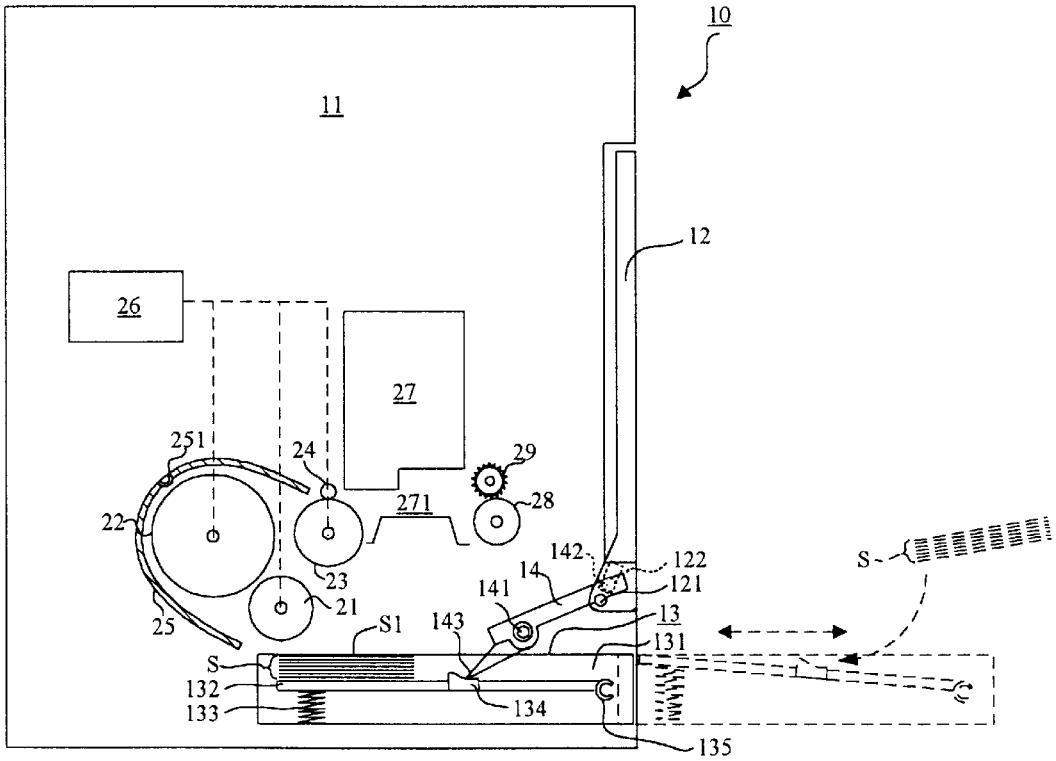
Figure 2C:
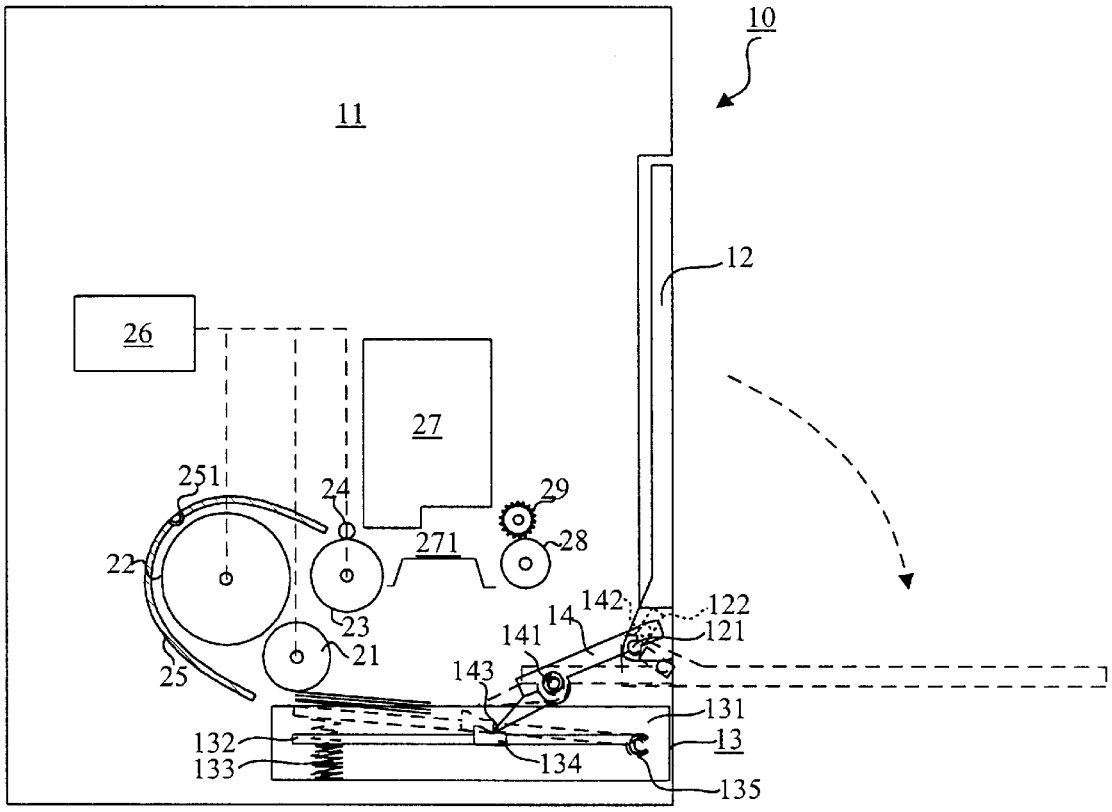

FIG. 2C is a diagram showing how the tray 132 shown in FIGS. 2A and 2B moves forward or backward the pickup roller 21 in response to the opening and closing of the first paper accommodating device 12.

Figure 3A:
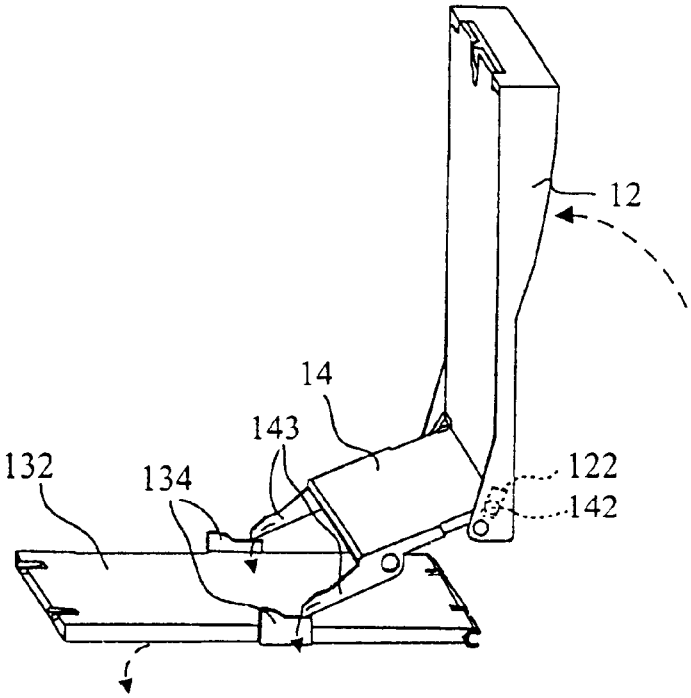
Figure 3B:
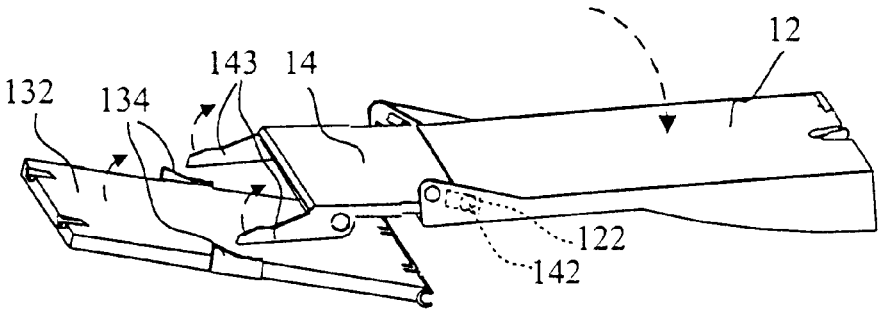

FIGS. 3A and 3B are diagrams showing the connection relationship between the first paper accommodating device 12 actuating plate 14 of FIGS. 2A and 2B and the actuation relationship between actuating plate 14 and the tray 132 in response to the closing or opening of the first paper accommodating device 12.

DETAILED DESCRIPTION OF THE INVENTION

Figure 1A:
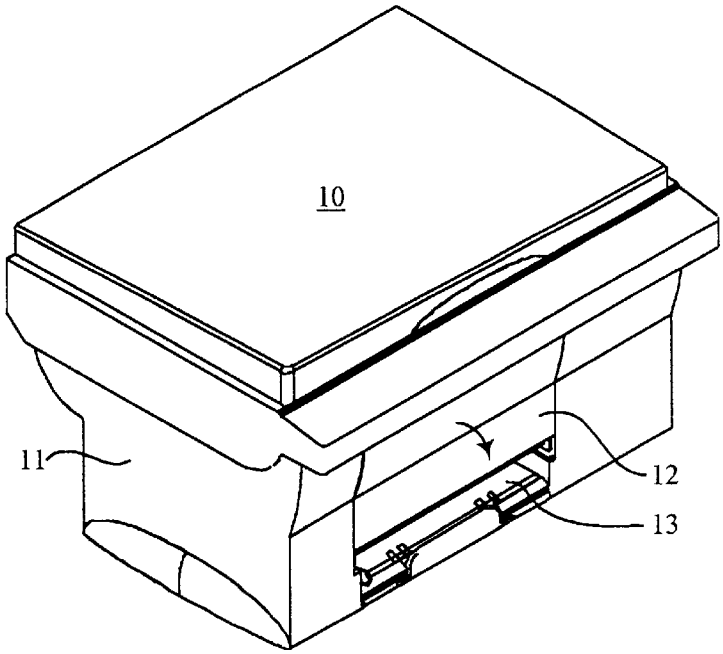
FIGS. 1A and 1B are perspective views of an office machine 10 employing a paper accommodating assembly according to a preferred embodiment of the invention.
Figure 1B:
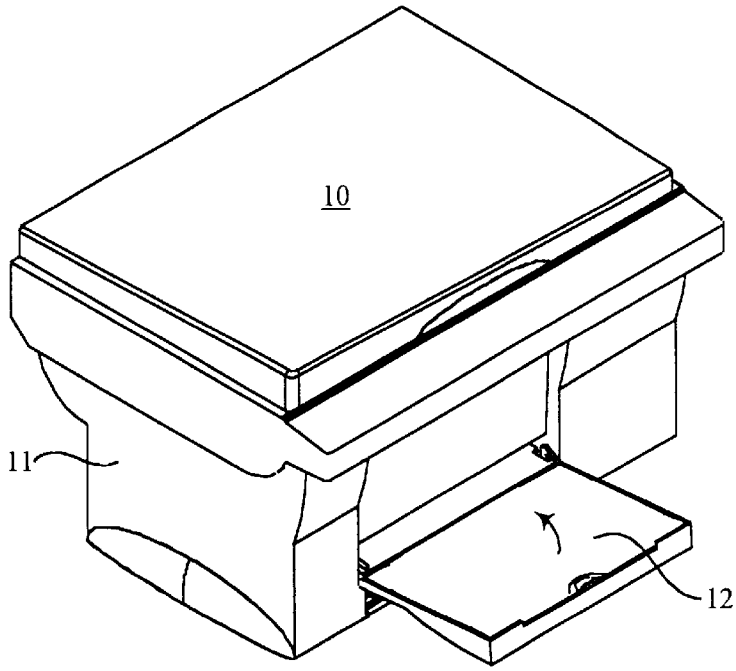

Referring to FIGS. 1A and 1B, an office machine 10 employing a paper accommodating assembly according to a preferred embodiment of the invention is disclosed. The paper accommodating assembly is for accommodating paper sheets to be processed and paper sheets having been processed by the office machine 10. The office machine 10 may be a printer, a copy machine, a scanner, a multifunction office machine, or an all-in-one office machine.

As shown in FIGS. 1A and 1B, the paper accommodating assembly includes a first paper accommodating device 12 for accommodating the paper sheets having been processed by the office machine 10 and a second paper accommodating device 13 for accommodating the paper sheets to be processed by the office machine 10. The office machine 10 includes a machine body 11 to which the first paper accommodating device 12 is pivotally connected via a first pivot 121. So the first paper accommodating device 12 can rotate to a closed position or an open position via the first pivot 121. When rotated to the open position, the first paper accommodating device 12 is provided to accommodate the paper sheets to be processed by the office machine 10. When rotated to the closed position, the first paper accommodating device serves as a smooth surface of the office machine 10. The second paper accommodating device 13 is capable of moving within or out of the machine body 11. In particular, the feeding path of the paper sheets accommodated by the second paper accommodating device 13 is clear and connected when the first paper accommodating device 12 is in the open position. Meanwhile, the feeding path of the paper sheets is interrupted and blocked when the first paper accommodating device 12 is in the closed position.

The internal construction of the office machine 10 and the principle regarding the connection or blocking of the feeding path of the paper sheets accommodated by the second paper accommodating device 13 will be described in detail as follows. Referring to FIGS. 2A and 2B, the office machine 10 includes a paper feeding apparatus, a paper processing apparatus 27 and a paper discharging apparatus. The paper processing apparatus 27 is for processing the paper sheets delivered thereat, e.g., recording information onto the paper sheets or retrieving image on the paper sheets. The paper feeding apparatus is for feeding, one by one, the paper sheets S accommodated by the second paper accommodating device 13 into a processing path 271 of the paper processing apparatus 27 so that components of the paper processing apparatus 27 can perform the subsequent process on the paper sheets. After being processed by the paper processing apparatus 27, the paper sheets are delivered to the first paper accommodating device 12 and further accommodated by the first paper accommodating device 12.

Also shown in FIGS. 2A and 2B, an embodiment of the paper feeding apparatus is disclosed. The paper feeding apparatus includes a pickup roller 21, a delivery roller 22, a pair of feed rollers (23 and 24), a guide board 25 and a driving device 26. The pickup roller 21 is for selectively picking up and further delivering an uppermost sheet S1 of the paper sheets S accommodated by the second paper accommodating device 13. As picking up the paper sheet S1, the pickup roller 21 rotates in a clockwise direction 211. The delivery roller 22 works with the guide board 25 to deliver the paper sheet S1 to the feed rollers (23 and 24). As delivering the paper sheet S1, the delivery roller 22 also rotates in the clockwise direction 211. Also shown in FIGS. 2A and 2B, the direction of the paper sheets delivered through the delivery roller 22 and the guide board 25 is altered to reduce the space required by the office machine 10. To alter the direction of the delivered paper sheet S1 successfully, a follow roller 251 is set at the guide board 25 to help the delivered paper sheet alter its delivery direction. The pair of feeding rollers (23 and 24) are composed of an active roller 23 and an idle roller 24. To feed paper sheets into the processing apparatus accurately, first, the active roller 23 rotates in a counterclockwise direction 231 to resist the paper sheet delivered from the delivery roller 22 so as to justify the leading edge of the paper sheet until the leading edge of the paper sheet fully contact with the feeding roller (23 and 24). Then, the rotating direction of the active roller 23 is altered into the clockwise direction to deliver the paper sheet S1 into the processing path 271 of the paper processing apparatus 27. The driving device 26 is for driving the rotation of the roller set in the paper feeding apparatus.

Also shown in FIGS. 2A and 2B, an embodiment of the paper discharging apparatus is disclosed. The paper discharging apparatus includes a pair of discharge roller (28 and 29). The pair of discharge rollers (28 and 29) are composed of an active roller 28 and an idle roller 29. Moreover, the active roller 28 is connected to the active roller 23 by a belt or odd numbered gears so that the active roller 28 takes the same rotating operation as the active roller 23. When discharging of the paper sheet S1, first, the rotating direction of the active roller 28 is the counterclockwise direction. Then, the rotating direction of the active roller 28 is altered into the clockwise direction to discharge the paper sheet within the processing path to the first paper accommodating device 12.

Also shown in FIGS. 2A and 2B, an embodiment of the paper accommodating assembly also includes an actuating plate 14 pivotally mounted on the inner wall of the machine body 11 via the second pivots 141. The first paper accommodating device 12 has at least one guide path 122, and the actuating plate 14 has at least one boss 142 which each projects and slides within one corresponding guide path 122. Thereby, when rotating, the first paper accommodating device 12 guides the actuating plate 14 to rotate. Also in the embodiment, the second paper accommodating device 13 includes a base 131, a tray 132 and a resilient member 133. The tray 132 is pivotally mounted on the inner wall of the base 131 via the third pivots 135. The tray 132 is for loading the paper sheets to be processed by the office machine 10. The resilient member 133 is set between a free end of the tray 133 and the base 131 for supporting the tray 132. The resilient member 133 may be a coil spring or a leaf spring.

It should be noted that the boss 142 of the actuating plate 14 and the guide path 122 of the first paper accommodating device 12 can be interchangeable installed on either the actuating plate 14 or the first paper accommodating device 12. In other words, the boss 142 can be arranged on the first paper accommodating device 12, and the guide path 122 can be arranged on the actuating plate 14. As long as there is a rotatable and movable connection between the actuating plate 14 and the first paper accommodating device 12, it will suffice.

As shown in FIG. 2B, when rotating from the open position to the closed position, the first paper accommodating device 12 rotates counterclockwise around the first pivots 121. At the same time, the first paper accommodating device 12 guides the actuating plate 14 to rotate around the second pivots 141. Further, the actuating plate 14 by at least one actuating end 143 thereof actuates the tray 132 to move away from the pickup roller 21. As the tray 132 is actuated to move away from the pickup roller 21, the paper sheets loaded by the tray 132 are taken away from the pickup roller 21 so that the feeding path of the paper sheets loaded by the tray 132 is interrupted and blocked. The tray 132 also has at least one arc slide 134 set on its side. Each of the arc slide 134 corresponds to one actuating end 143 of the actuating plate 14. During actuation of the tray 132 by the actuating plate 14, the actuating end 143 slide on arc surface of the arc slide 134. In this embodiment, the actuating plate 14 indirectly actuates the tray 132 via the arc slide 134 so that the feeding of the paper sheets loaded in the tray 134 will not be interrupted by the operation of the actuating plate 14.

As shown in FIG. 2A, as rotating from the closed position to the open position, the first paper accommodating device 12 rotates clockwise around the first pivots 121 and further guides the actuating plate 14 to rotate clockwise around the second pivots 141 so that the actuating end 143 escapes from the arc slide 134. At this time, the compressed resilient member by the elastic force thereof supports the tray 132 to move forward to the pickup roller 21 so that the uppermost sheet of the paper sheets loaded by the tray 132 contacts the pickup roller 21, so the feeding path of the paper sheets is connected. FIG. 2C shows clearly the actuating relationship between the actuating plate 14 and the tray 132 as the first paper accommodating device 12 closes or opens.

The connection relationship between the first paper accommodating device 12 and the actuating plate 14 is illustrated in detail in FIGS. 3A and 3B. As shown in FIGS. 3A and 3B, the dotted-line arrows indicate the moving direction of the first paper accommodating device 12, actuating plate 14 and tray 132, respectively, as the first paper accommodating device 12 closes or opens. As the first paper accommodating device 12 rotates to the closed position, the actuating plate 14 rotates to actuate the tray 132 moving away from the pickup roller 21, as shown in FIG. 3A. As the first paper accommodating device 12 rotates to the open position, the actuating plate 14 rotates to escape from the tray 132. Under this condition, the tray 132 is not actuated by the actuating plate 14 so that the compressed resilient member 132 pushed by elastic force thereof supports the tray 132 moving forward to the pickup roller 21, as shown in FIG. 3B.

In another preferred embodiment of the invention, the actuating 14 is engaged with or monolithically formed with the first paper accommodating device 12 rather than pivotally mounted on the inner wall of the machine body 11.

While the invention has been described in one presently preferred embodiment, it is understood that the words which have been used are words of description rather than words of limitation and that changes within the purview of the appended claims may be made without departing from the scope and spirit of the invention in its broader aspect.

What is claimed is:

1. An office machine comprising:

a machine body;

a feed roller for selectively picking up and further delivering an uppermost sheet of paper sheets to be processed by said office machine when contacting the uppermost sheet;

a first paper accommodating device, rotatably mounted on the machine body, for accommodating the paper sheets having been processed by said office machine when rotating to an open position;

a second paper accommodating device for accommodating the paper sheets to be processed and, responsive to the movement of the first paper accommodating device to the open position, supporting the paper sheets to be processed to move forward to the feed roller so that the uppermost sheet of the paper sheets to be processed contacts the feed roller.

2. The office machine of claim 1, further comprising an actuating plate, responsive to the movement of the first paper accommodating device from the open position to a closed position, for actuating the second paper accommodating device so that the paper sheets to be processed are taken away from the feed roller.

3. The office machine of claim 2, wherein the second paper accommodating device comprises:

a case body capable of moving within or out of the machine body;

a tray rotatably mounted on an inner wall of the case body for loading the paper sheets to be processed, wherein when the second paper accommodating device is actuated, the tray is actuated by the actuating plate to rotate away from the feed roller so that the paper sheets loaded by the tray is taken away from the feed roller;

a resilient support member, disposed between the case body and the tray, for supporting for the tray.

4. The office machine of claim 3, wherein the actuating plate is rotatably mounted on the inner wall of said office machine, and wherein the actuating plate via a free end thereof actuates the tray to rotate when the movement of the first paper accommodating device from the open position to the closed position takes place.

5. The office machine of claim 4, wherein the first paper accommodating device has at least one guide path, and the actuating plate has at least one boss which each projects and slide within one corresponding guide path, whereby when the first paper accommodating device rotates, the actuating plate rotates with the first paper accommodating device together for selectively actuating the tray.

6. A paper accommodating assembly for an office machine, comprising:

an initial paper accommodating device for accommodating paper sheets to be processed by said office machine, a pickup roller feeding roller for selectively picking up and further delivering an uppermost sheet of the paper sheets to be processed when contacting the uppermost sheet of the paper sheets to be processed;

a finish paper accommodating device, switchable between an open position and a closed position, for accommodating paper sheets being processed by said office machine when switching to the open position;

wherein when the finish paper accommodating devices switches to the open position, the initial paper accommodating device moves forward to the pickup roller so that the uppermost sheet of the paper sheets to be processed contacts the pickup roller, and when the finish paper accommodating device switches to the closed position, the initial paper accommodating device moves away from the pickup roller so that the uppermost sheet of the paper sheets to be processed is taken away from the pickup roller.

7. The paper accommodating assembly of claim 6, wherein when switching to the closed position, the finish paper accommodating device serves as a smooth surface of said office machine.

8. The paper accommodating assembly of claim 6, wherein the finish paper accommodating device is rotatably mounted on said office machine.

9. The paper accommodating assembly of claim 6, wherein the initial paper accommodating device comprises:

a tray for loading the paper sheets to be processed, wherein when the finish paper accommodating device switches to the closed position, the tray moves away from the feed roller so that the paper sheets loaded by the tray are taken away from the feed roller.

a resilient support member for supporting the tray.

10. The paper accommodating assembly of claim 9, wherein the initial paper accommodating device further comprises a case body, the tray is rotatably mounted on an inner wall of the case body, and the resilient support member is disposed between the case body and a free end of the tray.

11. The paper accommodating assembly of claim 10, wherein when switching to the closed position, the finish paper accommodating device actuates the tray by an actuating plate to move the tray away from the pickup roller to take the uppermost sheet of the paper sheets to be processed away from the pickup roller.

12. The paper accommodating assembly of claim 11, wherein the finish paper accommodating device has at least one guide path, and the actuating plate has at least one boss which each projects and slides within one corresponding guide path, whereby when the finish paper accommodating device switches to the closed position, the actuating plate rotates with the first paper accommodating device together to actuate the tray.

13. A paper accommodating assembly for an office machine, comprising:

an initial paper accommodating device for accommodating paper sheets to be processed by said office machine;

a pickup roller feeding roller for selectively picking up and further delivering an uppermost sheet of the paper sheets when contacting the uppermost sheet of the paper sheets;

a finish paper accommodating device, rotatable between an open position and a closed position, for accommodating paper sheets being processed by said office machine when rotating to the open position;

an actuating device, engaged with the finish paper accommodating device, for selectively actuating the initial paper accommodating device to move away from the pickup roller; and wherein when rotating to the closed position, the finish paper accommodating device actuates the initial paper accommodating device by the actuating device to move away from the pickup roller so that the uppermost sheet of the paper sheets to be processed contacts the pickup roller, and when rotating to the open position, the initial paper accommodating device departs from the initial paper accommodating device so that the initial paper accommodating device moves forward to the pickup roller and the uppermost sheet of the paper sheets contacts the pickup roller.

14. The paper accommodating assembly of claim 13, wherein the finish paper accommodating device has at lease one guide path, and the actuating device has at least one boss which each projects and slides within one corresponding guide path, whereby when the finish paper accommodating device rotates to the open position or the closed position, the actuating plate rotates with the first paper accommodating device together to actuate or depart from the initial paper accommodating device.

15. The paper accommodating assembly of claim 13, wherein the finish paper accommodating device is rotatably mounted on said office machine.

16. The paper accommodating assembly of claim 13, wherein when rotating to the closed position, the finish paper accommodating device serves as a smooth surface of said office machine.

17. The paper accommodating assembly of claim 13, wherein the initial paper accommodating device comprises:

a tray for loading the paper sheets to be processed, wherein when the finish paper accommodating device rotates to the closed position, the tray moves away from the feed roller so that the paper sheets loaded by the tray are taken away from the feed roller;

a resilient support member for supporting the tray.

18. The paper accommodating assembly of claim 17, wherein the initial paper accommodating device further comprises a case body, the tray is rotatably mounted on an inner wall of the case body, and the resilient support member is disposed between the case body and a free end of the tray.

* * * * *